US007871177B1

(12) United States Patent
Hanchett

(10) Patent No.: US 7,871,177 B1
(45) Date of Patent: Jan. 18, 2011

(54) LIGHT MOUNTING APPARATUS

(76) Inventor: Neville Blake Hanchett, 2964 E. 61st St., Cleveland, OH (US) 44127

( * ) Notice: Subject to any disclaimer, the term of this patent is extended or adjusted under 35 U.S.C. 154(b) by 142 days.

(21) Appl. No.: 12/290,780

(22) Filed: Nov. 3, 2008

Related U.S. Application Data

(60) Provisional application No. 61/001,512, filed on Nov. 1, 2007.

(51) Int. Cl.
*F21V 33/00* (2006.01)

(52) U.S. Cl. ..... 362/190; 362/191; 362/119

(58) Field of Classification Search ..... 362/109, 362/119, 120, 190, 191
See application file for complete search history.

(56) References Cited

U.S. PATENT DOCUMENTS

| | | | | |
|---|---|---|---|---|
| 5,303,133 | A | 4/1994 | Wagner | 362/157 |
| 5,573,329 | A | 11/1996 | Van Gennep | 362/191 |
| 5,683,171 | A | 11/1997 | Van Gennep | 362/191 |
| 5,738,432 | A * | 4/1998 | Okko et al. | 362/103 |
| 5,797,670 | A | 8/1998 | Snoke et al. | 362/119 |
| 5,810,525 | A | 9/1998 | Ector, Sr. | 408/241 R |
| 5,842,584 | A | 12/1998 | Baird | 211/69.1 |
| 5,954,458 | A | 9/1999 | Lee | 408/16 |
| 6,168,287 | B1 | 1/2001 | Liu | 362/119 |
| 6,186,638 | B1 | 2/2001 | Chang | 362/119 |
| 6,502,949 | B1 | 1/2003 | Horiyama et al. | 362/119 |
| 6,575,590 | B1 | 6/2003 | Wadsworth | 362/119 |
| 6,729,480 | B1 | 5/2004 | Blake | 211/70.6 |
| 6,729,743 | B2 | 5/2004 | Gillette | 362/191 |
| 6,890,135 | B2 | 5/2005 | Kopras et al. | 409/182 |
| 6,964,545 | B1 | 11/2005 | Languasco | 408/16 |
| 2003/0161139 | A1 * | 8/2003 | Putallaz | 362/108 |
| 2004/0100792 | A1 * | 5/2004 | Trzecieski | 362/103 |

* cited by examiner

*Primary Examiner*—Laura Tso

(57) ABSTRACT

A light mounting apparatus is being proposed herein. The light mounting apparatus is formed to as to allow for versatile usage, in connection with a wide variety of tools, structures, and surfaces. Furthermore, the light mounting apparatus includes suitable connection structures to a light source in order to provide multiple degrees of freedom, thereby allowing a user to easily direct light beams to a desired location.

12 Claims, 21 Drawing Sheets

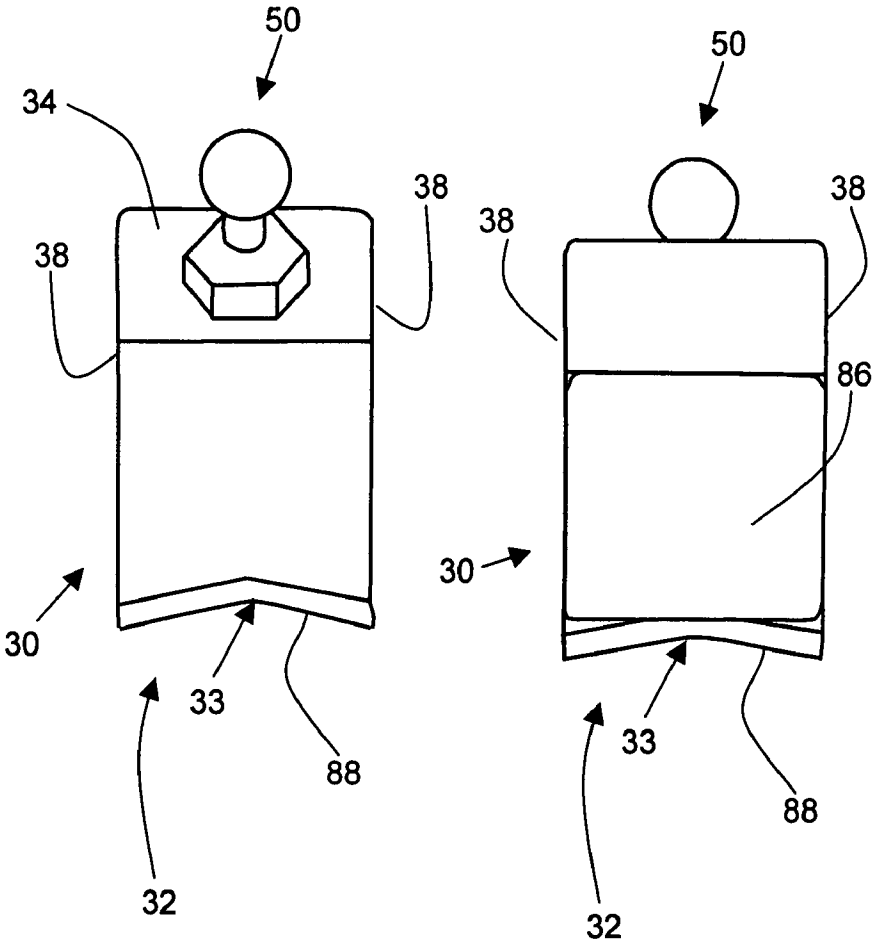
FIGURE 3C
FIGURE 3B
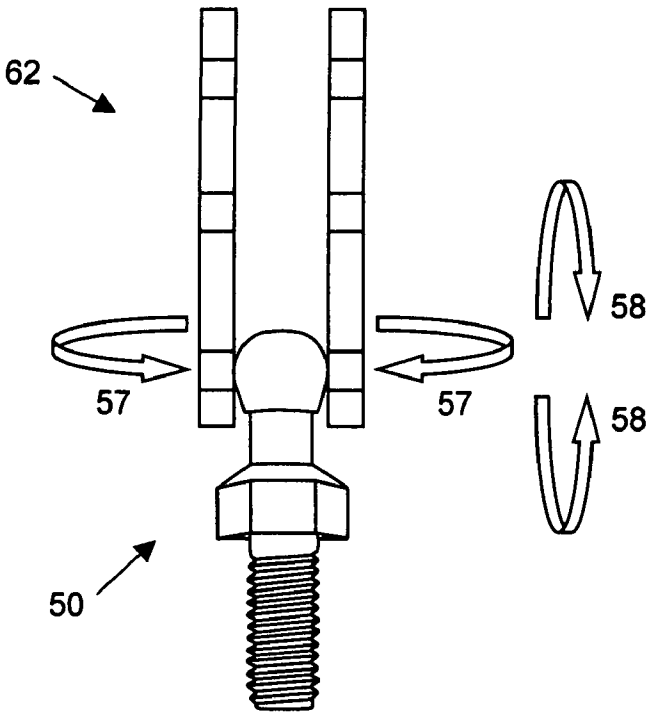
FIGURE 3D

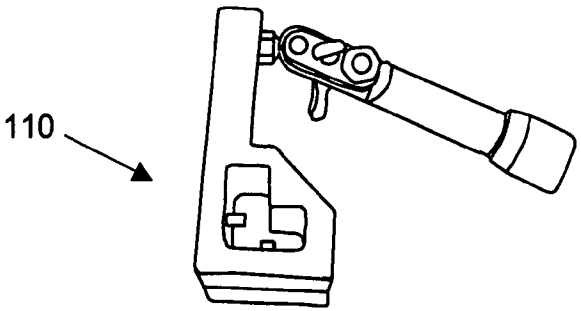
FIGURE 10C
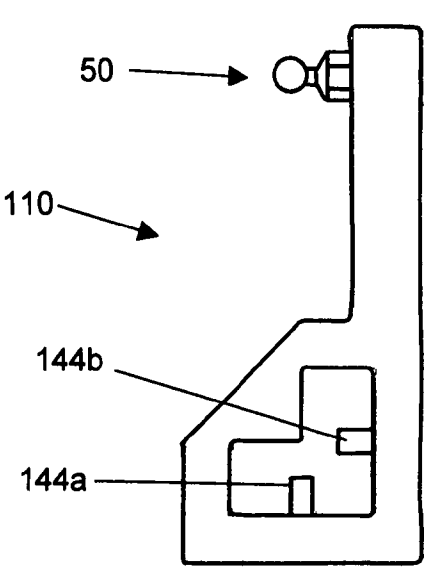
FIGURE 10E
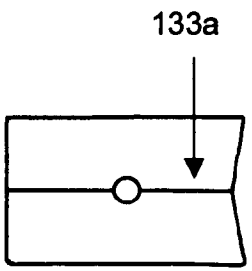
FIGURE 10F
FIGURE 10D

LIGHT MOUNTING APPARATUS

RELATED APPLICATIONS

This application is related to and claims priority from U.S. Provisional Patent Application Ser. No. 61/001,512 filed Nov. 1, 2007 which is incorporated by reference herein.

TECHNICAL FIELD

This invention relates generally to the field of light mounting apparatus, and more particularly to light mounting apparatus suitable for attachment to a variety of tools, structures and/or surfaces.

BACKGROUND ART

U.S. Pat. Nos. 5,573,329 and 5,683,171 shows an example whereby a cylindrical unit is supposedly strapped to a drill to direct a light beam to a workpiece or the like. However, significant problems arise when attempting to attach a device in this manner. Various attempts to solve this problem have been attempted:

U.S. Pat. No. 5,303,133 shows a light mounting structure for a fishing pole;

U.S. Pat. No. 5,797,670 shows a belt where light focus is adjusted by a gooseneck structure;

U.S. Pat. No. 6,186,638 shows a wrench with a flashlight; U.S. Pat. Nos. 6,502,949 and 6,575,590 show a light between a tool and a battery;

U.S. Pat. Nos. 6,890,135 and 6,168,287 show an LED light built into tool, and U.S. Pat. No. 5,954,458 shows a pop up light;

U.S. Pat. Nos. 5,842,584 and 6,729,480 show a belt with loops for holding bits etc.;

U.S. Pat. No. 5,810,525 shows sleeves with pockets for accessories;

U.S. Pat. No. 6,964,545 shows a hook and loop faster directly on a tool; and

U.S. Pat. No. 6,729,743 shows a light adapted to fit into a bit holder cavity.

None of these patents provide a device that is versatile for use with many different types of tools and in different environments, with many degrees of adjustability.

BRIEF SUMMARY OF THE INVENTION

A light mounting apparatus is being proposed herein. The light mounting apparatus is formed to as to allow for versatile usage, in connection with a wide variety of tools, structures, and surfaces. Furthermore, the light mounting apparatus includes suitable connection structures to a light source in order to provide multiple degrees of freedom, thereby allowing a user to easily direct light beams to a desired location.

Advantageously, the light mounting apparatus herein provides one with the ability to position a light source on a tool, upon a variety of surfaces, or in other locations, with the ability to direct a light beam in a desisted location. Compared to conventional light assemblies discussed in the background of the invention, the herein light mounting apparatus may be removed, used with multiple tools and types of tools, attached to other surfaces, and with many degrees of adjustability.

BRIEF DESCRIPTION OF THE FIGURES

The foregoing summary as well as the following detailed description of preferred embodiments of the invention will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings, where:

FIGS. 3A-3C show side and elevation views of the light mounting apparatus as shown in FIGS. 1A and 1B;

FIG. 3D shows an enlarged view of a bracket assembly and corresponding bracket assembly mounting structure of a the light mounting apparatus such as the one shown in FIGS. 1A and 1B;

FIGS. 10A-10C show an isometric view of a light mounting apparatus according to another embodiment herein attached to a tool, the light mounting apparatus with a strap, and the light mounting apparatus without a strap, respectively;

FIGS. 10D-10F show a side view, bottom view along an extension leg, and bottom view of the short end of a light mounting apparatus, respectively;

FIG. 13F shows the light mounting apparatus of FIGS. 13A-13C attached to the handle portion of a cutting tool;

DETAILED DESCRIPTION OF THE FIGURES

A light mounting apparatus is being proposed herein. The light mounting apparatus is formed to as to allow for versatile usage, in connection with a wide variety of tools, structures, and surfaces. Furthermore, the light mounting apparatus includes suitable connection structures to a light source in order to provide multiple degrees of freedom, thereby allowing a user to easily direct light beams to a desired location.

In certain embodiments, the light mounting apparatus allows one to easily attach and detach it at various locations on a tool, thereby affording the ability to position a light source (e.g., a conventional pocket flashlight) and direct a light beam from the light source on a desired position of a workpiece. In certain additional embodiments, the light mounting apparatus may be easily attached and detached to a variety of structures, e.g., within a home, workshop, or automobile, whereby a user may direct light to a desired position. In further embodiments, a portion of the light mounting apparatus includes a magnetic material, thereby allowing a user to position it upon a metallic object or surface and accordingly direct a light beam to a desired position.

Figure 1B:
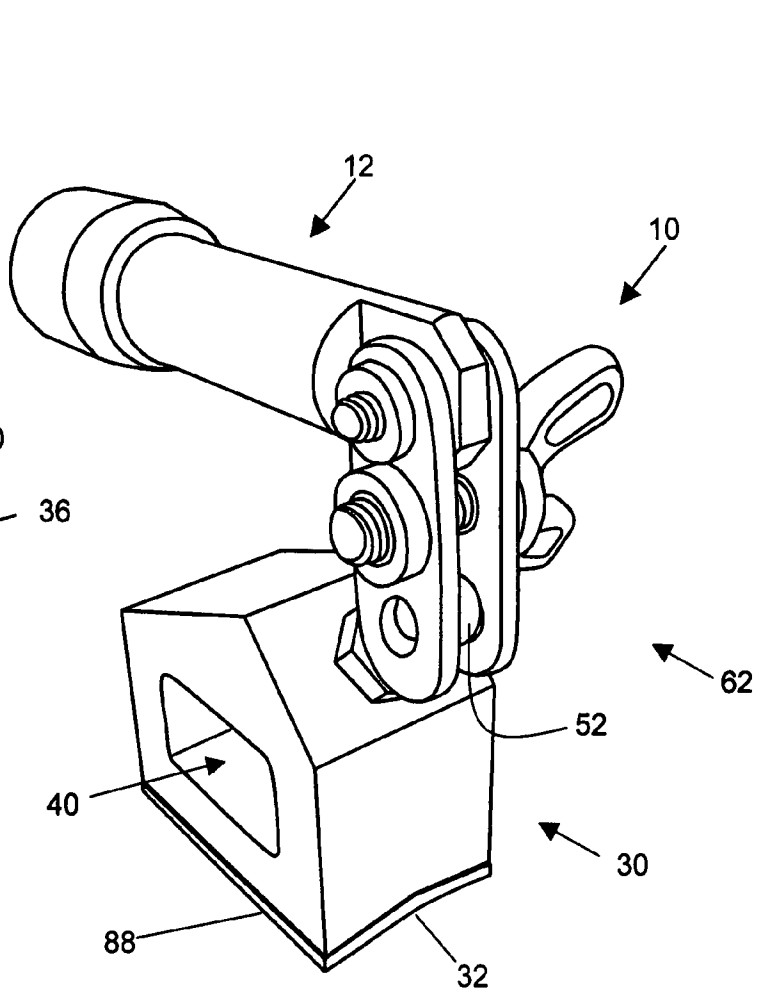
FIGS. 1A and 1B show isometric views of a light mounting apparatus according to one embedment herein.
Figure 1A:
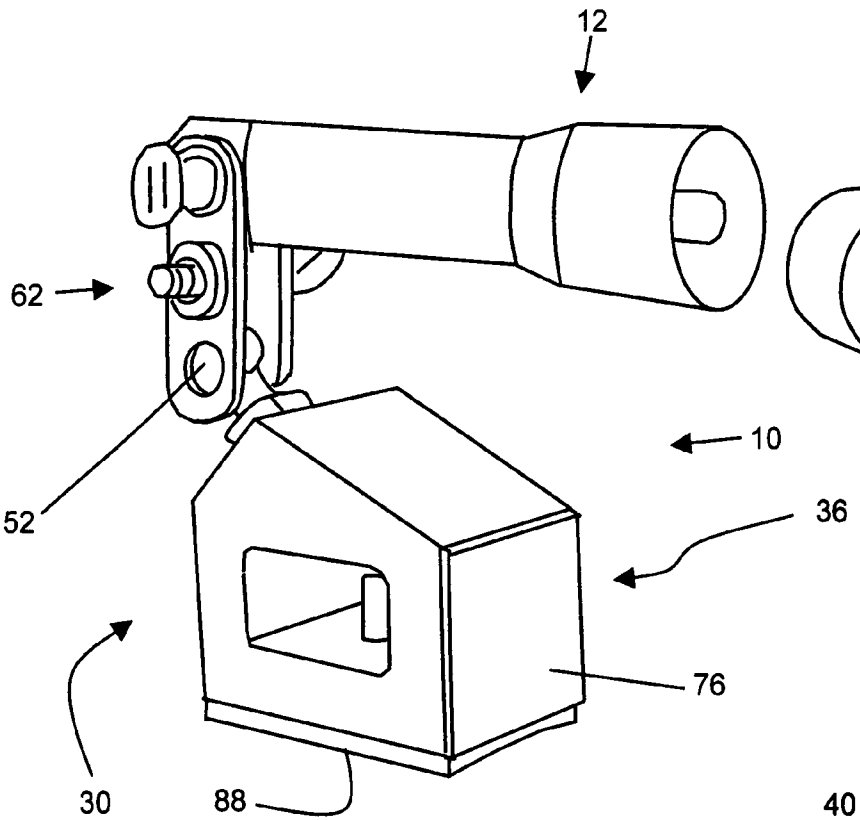

Referring to FIGS. 1A and 1B, an embodiment of a light mounting apparatus 10 is illustrated in perspective view, having a light source 12 (e.g., a conventional mini or pocket flashlight) attached thereto via an adjustable assembly including a bracket assembly 62. The bracket assembly 62 is attached to a body 30 as described herein, wherein the body 30 may be removably attached to a tool 14 (as shown in FIGS. 2A through 2E) or another suitably dimensioned object or structure. Notably, the apparatus 10 herein allows for a secure attachment to a tool, and allows a user to direct a light beam to any suitable position (e.g., the location where a hole is to be drilled in the case of the tool 14 being a drill, or along a cut line in the case of a tool 14 being a cutting tool such as a saw).

Figure 2A:
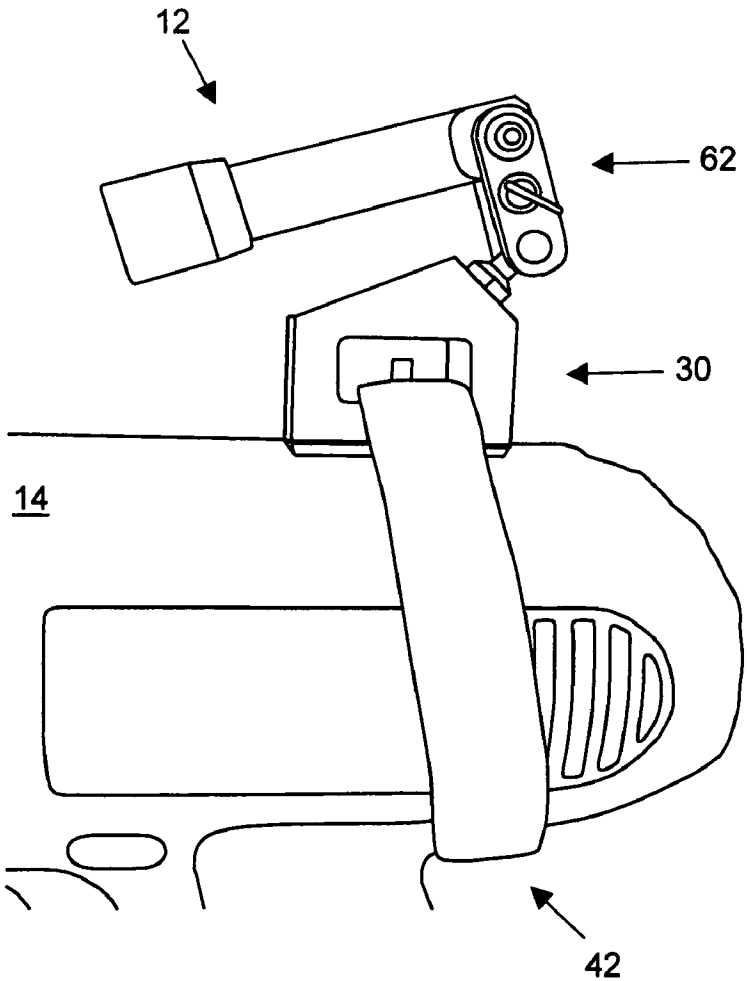
FIGS. 2A-2E show the light mounting apparatus as shown in FIGS. 1A and 1B mounted upon a drill to illuminate a target area.
Figure 2C:
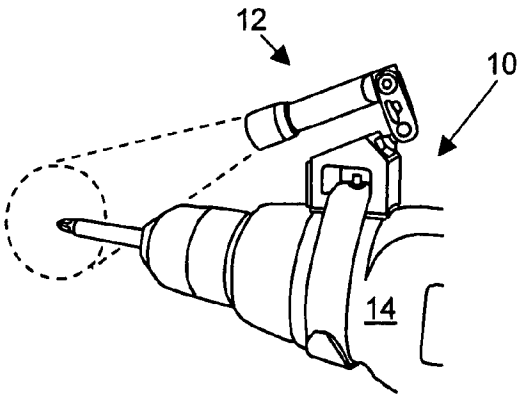
Figure 2E:
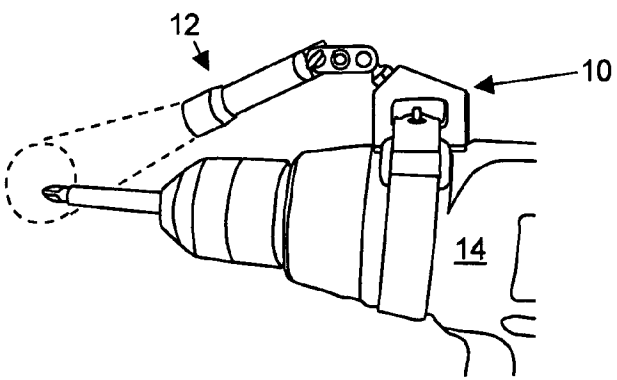
Figure 2B:
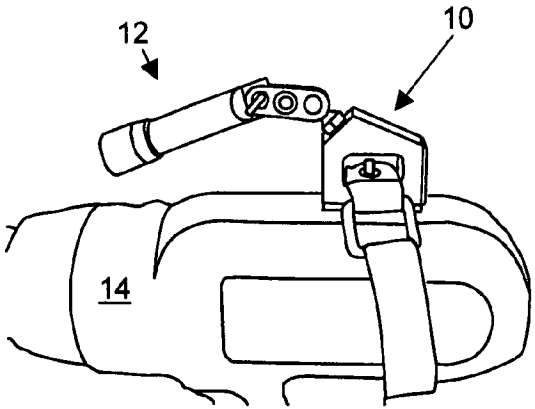
Figure 2D:
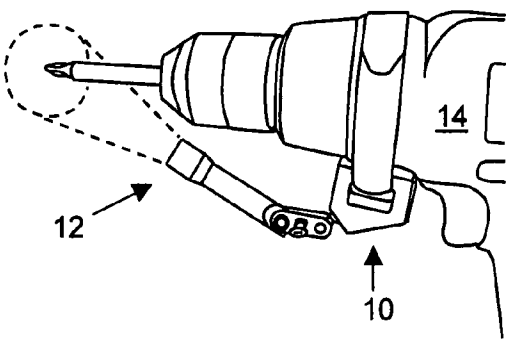

FIGS. 2A through 2E demonstrate only a few of the many ways in which a light mounting apparatus 10 according to certain embodiments herein may be positioned upon a tool 14, and the various locations on the tool where it may be attached. FIGS. 2A and 2B show the apparatus 10 attached in different ways toward a back end of a tool 14, and FIGS. 2C through 2E show the apparatus 10 attached in different ways toward a front end of a tool. Many other variations are possible. For example, the apparatus 10 may be positioned proximate a base of a tool 14, such as a drill. Additionally, body 30 may be configured upon a tool 14 so that the bracket assembly 62 is oriented on the drill/driver bit side of the tool (e.g., as shown in FIGS. 2B, 2D and 2E) or oriented on the back side of the tool 14 (e.g., as shown in FIGS. 2A and 2B).

Figure 3A:
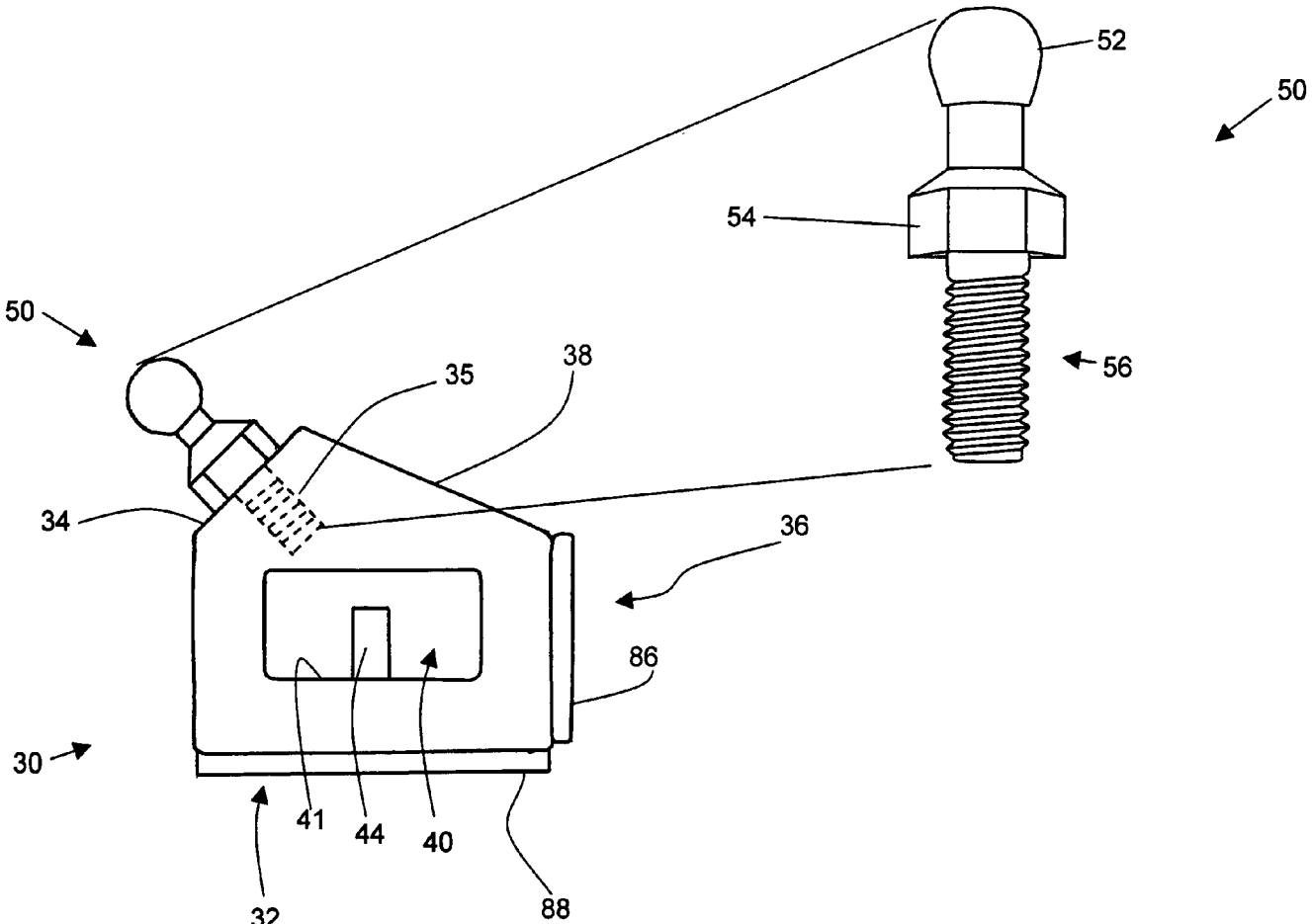

Referring now to FIGS. 3A through 3C, side and end elevation views of a body 30 of a light mounting apparatus 10 provided. In general, the body 30 includes side faces 38 and a plurality of faces 32, 34, 36. The face 32 provides a seating base 32, configured for seating the apparatus 10 upon various locations upon a tool. In addition, the face 34 provides a light mount face 34. The body 30 also includes another face 36 (adjacent the seating base 32), along with other optional faces (e.g., as shown in FIGS. 3A through 3C, one additional face is between seating base 32 and the light mount face 34, and another face is between light mount face 34 and edge 36). Note that the body may have fewer or more faces than depicted. For instance, in certain alternatives, the body 30 may be in the form of a prism with faces 38 and three faces including seating base 32, light mount face 34 and one other face. In other embodiments, the body 30 may be in the form of a prism with faces 38 and N faces, wherein N is any integer greater than or equal to 3, whereby certain of the N faces include seating base 32 and light mount face 34. In still further alternatives, certain surfaces may be curved, wherein the faces are not necessarily well defined.

Figure 6A:
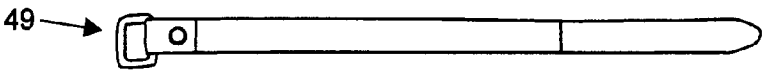
FIGS. 6A and 6B show a strap that may be used to secure the light mounting apparatus to a tool.
Figure 6B:
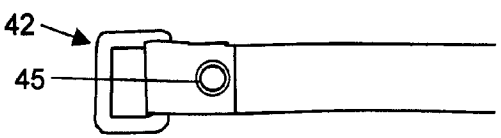

The body 30 further includes a strap receiving aperture 40, which is configured and dimensioned to allow a strap 42 (shown in FIGS. 2A through 2E and FIGS. 6A and 6B) to pass therethrough. A receiving structure 44 is within the strap receiving aperture 40 that is configured, positioned and dimensioned for receiving an aperture 45 of a strap 42 (FIGS. 6A and 6B). For instance, as shown in FIG. 3A, the structure 44 may be in the form of a post that extends substantially perpendicular from an inside surface 41 of the strap receiving aperture 40, e.g., opposite the surface of the seating base 32. Note that in certain embodiments, plural receiving structures 44 may be provided, for example, in the body 30 as shown in the FIGS. 3A through 3C upon an inside face or surface of the strap receiving aperture 40, e.g., opposite the seating face 32, and another receiving structure upon an inside face or surface of the strap receiving aperture 40 opposite the face 36 (whereby when the strap aperture 45 is affixed to this receiving structure opposite the face 36, the face 36 serves as a seating edge). This provides additional versatility and flexibility to a user, in that certain angles of the outer faces of the body 30 may be desirable in certain situations.

The body 30 may be formed of any suitable material including but not limited to various plastics, woods, rubbers, metals, and combinations including at least one of the foregoing materials. In certain embodiments, engineering plastics such as acetal resin plastics may be used (e.g., commercially available from E.I. du Pont de Nemours and Company under the trade name Delrin®). In further embodiments, the body 30 may be formed entirely of, or include at least a portion thereof formed of, material having some degree of elasticity, such as rubber or urethane materials. The body 30 may be solid as show with respect to FIGS. 1A-3C, and 8-10J. Alternatively, a body may be formed as a frame structure, for instance, as shown with respect to FIGS. 11A-13E.

The straps may comprise various elongated articles of suitable length. For instance, the straps may comprise suitable flexible material such as canvas, leather, cotton, nylon, or other similar material having sufficient strength allow a user to repeatedly wrap and unwrap it around a tool with the requisite cinching force to tighten the light mounting apparatus 10 to a tool or other suitably dimensioned object or structure. In certain embodiments, the strap may have some degree of elasticity, for instance, natural or synthetic rubber (e.g., as shown with respect to FIGS. 11A-12D and FIG. 13B), or elasticized canvas, cotton, nylon, or other similar material. The strap may connect, for instance, as shown using a hook and loop fastening system, or other structures, such as buckles, end hooks, snap buttons, or a series of apertures along a sufficient length of the strap to allow one of the apertures to be positioned around the receiving structure 44 for a secure fit (e.g., as shown in FIGS. 13B and 12C). FIGS. 6A and 6B show an overall view and enlarged end view of a strap 42 as used with the light mounting apparatus 10. The strap 42 has a length that is sufficient to wrap around a tool. In certain embodiments, a kit may be provided with plural straps of differing length to allow device 10 to be utilized with a wider variety of tools, objects or structures, and upon a wider variety of positions upon the tools, objects or structures. Furthermore, although depicted as a substantially flat strap, the strap may be in the form of a cord (e.g., having a circular cross section).

In certain embodiments, as shown FIG. 6A, a surface of the strap 42 may include attachment structures such as hook and loop fasteners. For instance, the hook portion may be proximate one end and the loop portion along a substantial portion of the remainder of the strap 42. The aperture 45 may be reinforced, for instance, with a suitable grommet or other structural reinforcement to prevent tearing of the strap 42 around the aperture 45 when the strap is tightened. Further, a cinch ring 49 is provided at an end of the strap 42 opposite the end having the hook portions of the hook and loop fastener system. Accordingly, a user may place the aperture 45 over the receiving structure 44, wrap the strap 42 around the tool, object or structure, with the hook and loop fasteners facing outward, pass the end opposite the cinch ring 49 through the cinch ring 49, cinch the strap to a desired tightness, and attach the hook portions to the loop portions to secure the strap 42.

Figure 4A:
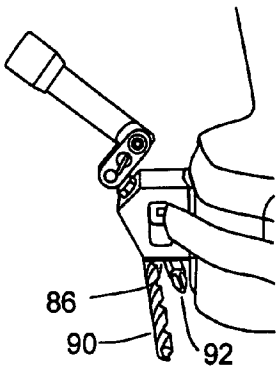
FIGS. 4A-4C show various mounting positions of the light mounting apparatus including drill or driver bits attached to a magnetic portion of the light mounting apparatus.
Figure 4B:
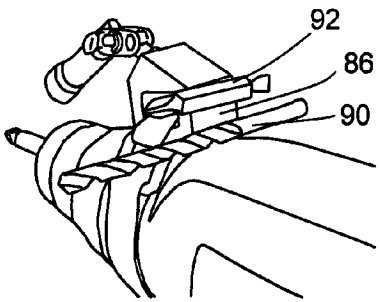
Figure 4C:
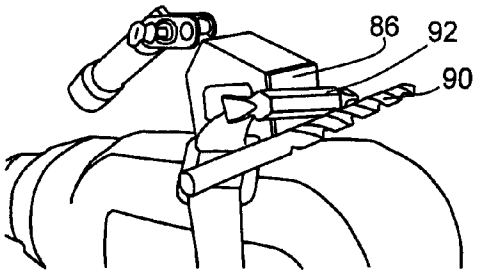
Figure 5:
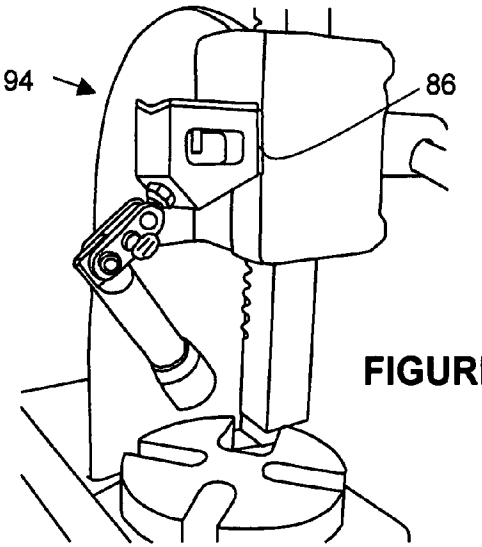
FIG. 5 shows the light mounting apparatus removably attached to a tool via the magnet portion thereof.

Referring back to FIGS. 3A and 3C, and also referring to FIGS. 4A through 4C and FIG. 5, a magnetic portion 86 may optionally be incorporated upon the body 30. For instance, as shown in the figures, a magnetic portion 86 on face 36. This provides additional versatility, for instance for holding by magnetic attraction ferrous objects, such as drill bits 90, driver bits 92, fasteners, or other small ferrous objects, as shown in FIGS. 4A through 4C. In addition, as shown in FIG. 5, magnetic portion 86 may be utilized to conveniently position the device 10 upon a ferrous object, such as a press 94, or any object having at least a portion thereof formed of a ferrous material, for instance, under the hood of an automobile, upon a refrigerator door, upon a toolbox, or upon any other object having at least a portion thereof formed of a ferrous material.

Referring back to FIG. 1, FIGS. 2A through 2E and FIGS. 3A through 3C, a cushion member 88 is provided upon the body 30, for instance, at the seating base 32. This cushion member 88 may be formed of any suitable material having the desired degree of elasticity and compressibility including but not limited to natural or synthetic rubber, natural or synthetic leather, soft wood materials (e.g., balsa wood), or other suitable materials. This cushion member 88 serves to allow for a tight cinch of the strap in removably attaching the device 10 to a tool by virtue of its compressibility, and further protects the surface of the tool from marring.

In certain embodiments, all of a portion of the seating base 32 may be removable. For instance, a kit may be provided that allows a user to replace a cushion material 88. In certain alternative embodiments, the seating base 32 may be removable to allow a user to change the angle of the groove. For instance, a kit may be provided with plural removably attachable base sections, each having a different angle groove. This may then be removably attached to the remainder of the body 30, for instance, with a suitable hook and loop fastener. This could also be used to allow a user to use the device without the grooved portion if desired. In addition, where a hook and loop fastener system is used to hold a removably attachable base section, when that base section is not attached, the device 10 may be employed by attaching to a surface having the mating loop or hook fastener. For instance, if the hook portion is used upon the body and the loop portion is used on the removably attachable base section, then a strip of a loop section may be adhered within an automobile, in a shop, or other location, and the strip may receive the hook portion on the body, thereby providing a further way to attach the device 10 to an object. Of course, if the body uses loop portions of a hook and loop fastener system, then a strip of corresponding hook portions may be adhered within an automobile, in a shop, or other location which can receive the loop portion on the body.

Referring back to FIGS. 3B and 3C, the seating face 32 is grooved 33 (or has at least a portion thereof in the form of a grooved region). For instance, in certain embodiments, the groove is provides in the form of a concave shape, such as a V shape, for instance, with an angle in the range of about 100 degrees to about 175 degrees. In certain preferred embodiments, for instance, where the seating base 32 is on the order of about ¾ inches to about 1¼ inches wide is to be seated on a tool or surface having a radius or equivalent radius of greater than about 2 inches (e.g., such as a drill), the angle is about 160 degrees to about 175 degrees. Alternatively, the groove may be a concave arc. This groove allows the body 30 to have at least two points of contact with the tool, thereby increasing stability and minimizing the likelihood of slippage. In contrast to the cylindrical body shown in U.S. Pat. No. 5,573,329, the concave groove enhances stability. Furthermore, in embodiments shown herein where the strap receiving structure 44 is positioned on a surface opposite the groove or surface having the grooved region, enhanced stability is attained.

In certain further alternatives, a pattern, such as a cross-hatch pattern could be molded or otherwise formed into the grooves to further increase stability and minimizing the likelihood of slippage.

FIGS. 3A through 3C also show that an adjustable assembly includes a bracket assembly mounting structure 50 extending from the light mount face 34. The bracket assembly mounting structure 50 is generally a structure suitable for receiving a bracket assembly 62 (detailed in FIG. 3D), shown in further detail with respect to FIGS. 1A, 1B, 7A and 7B. As shown, the bracket assembly mounting structure 50 is in the form of a ball 52 attached to a threaded portion 56, wherein the depth may be set with a suitable integrated or separate member 54, e.g., in the configuration of a threaded ball. As described further herein, this allows for various adjustment abilities when the bracket assembly 62 is attached to the ball portion 52 of the threaded ball, thus allowing for directing of the light beam. In addition, as shown, the ball stud may include a threaded portion 56 that may be screwed into an aperture 35 in the body 30 upon the light mount face 34. Referring to FIG. 3D, various degrees of freedom are provided by the bracket assembly mounting structure 50. For instance, the bracket assembly 62 may rotate as indicated by arrows 57, or pivot as indicated, by arrows 58.

Note that in certain embodiments, plural apertures may be positioned on the body 30, for example, upon different faces of the body 30. This allows a user to unscrew the bracket assembly mounting structure 50 and screw it into a different aperture at a different position or face on the body 30. In further alternatives, plural bracket assembly mounting structures 50 may be provided upon the body 30.

Figure 7B:
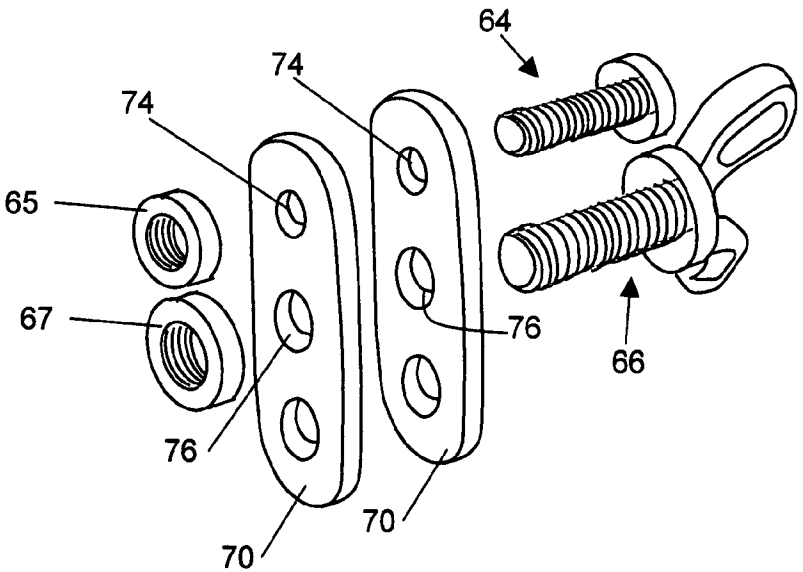
FIGS. 7A and 7B show the bracket assembly in a full and exploded view, respectively.
Figure 14:
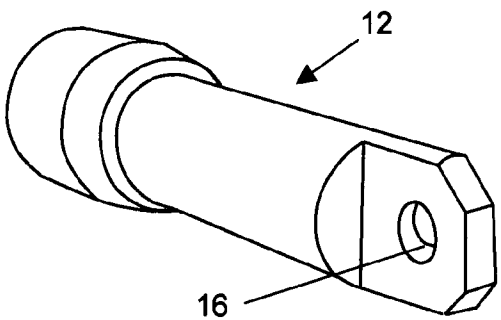
FIG. 14 shows an example of a light source having a suitable aperture at an end thereof for use with the various light mounting apparatus shown herein.
Figure 7A:
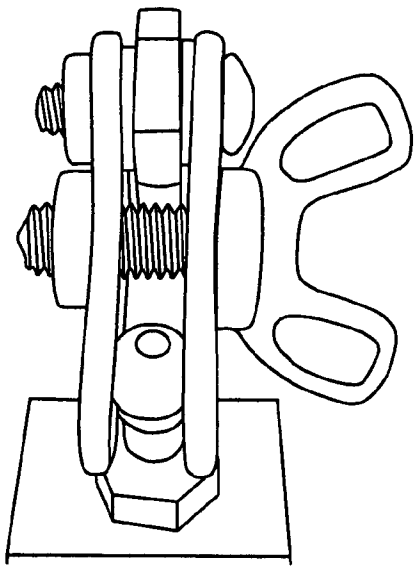

Referring to FIGS. 1B, 7A and 7B, bracket assembly 62 includes a pair of brackets 70, each having a light holding aperture 74 for receiving light holding structure 64; an adjustment aperture 76 for receiving an adjustment structure 66. For instance, light holding structure 64 may comprise a screw or bolt positioned through apertures 74 and an end aperture 16 of the light source 12 (shown in FIG. 14) and secured with a nut 65. Adjustment structure 66 may comprise a thumbscrew or other type of screw or bolt having a convenient structure for turning the screw without the need for tools, having a threaded portion that extends through apertures 76 and secured with a nut 67. The adjustment structure 66 provides the ability to expand and contract the bracket assembly 62 relative to the bracket assembly mounting structure 50. For instance, the adjustment structure 66 may be loosened to allow rotating or pivoting of the bracket assembly 62 relative the bracket assembly mounting structure 50 (e.g., as shown with respect to FIG. 3D). In addition, the light source 12 may be pivoted. The orientation (rotate and/or pivot) of the bracket assembly 62 relative to the bracket assembly mounting structure 50 and the orientation (pivot) of the light source 12 relative the bracket assembly 62 can be locked into place by tightening the adjustment structure 66.

In certain embodiments, in order to reduce friction when the adjustment structure 66 is tightened, one or more plastic washers may be used, for instance, between the end of the flashlight 12 proximate the end aperture 16 and one or both of the brackets 70.

Figure 8:
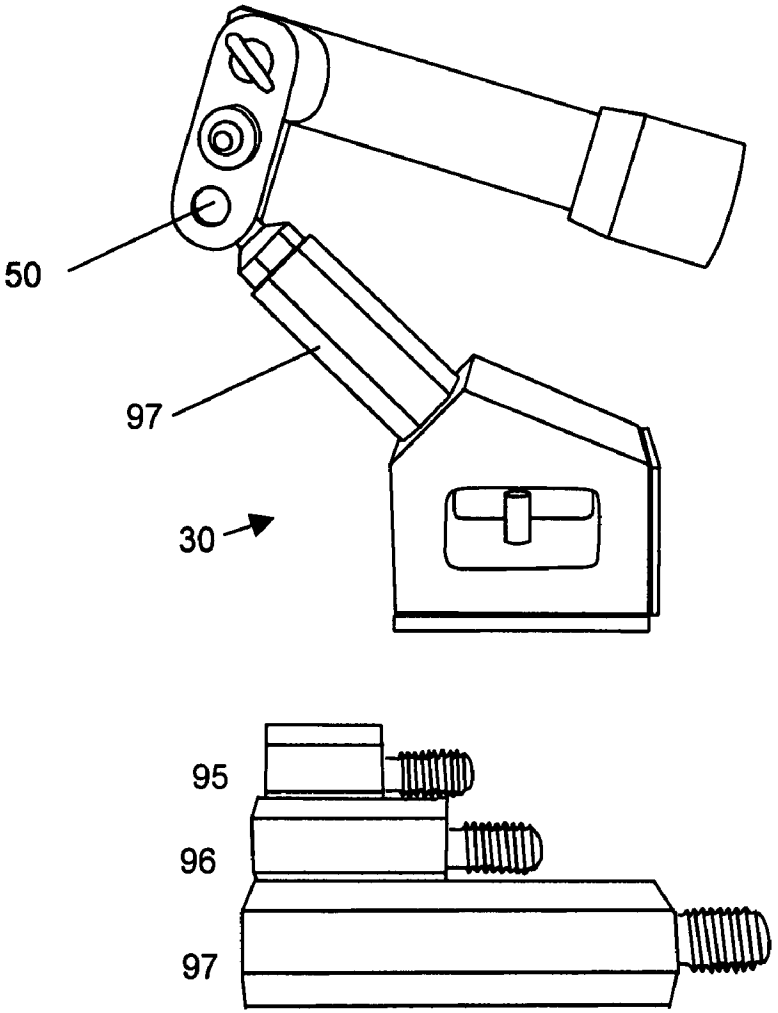
FIG. 8 shows another embodiment including a plurality of extension devices to further adjust the position of the light source.

FIG. 8 shows another embodiment of the present light mounting apparatus, wherein a kit is provided to a user having plural extension elements. For instance, a plurality of extension elements 95, 96, 97 may be provided, each having a different extension length. Bracket assembly mounting structure 50 having a threaded end is screwed into an end of the selected extension element 95, 96 or 97, and a threaded end of the selected extension elements 95, 96 or 97 screw into the aperture 35 upon the body 30 (e.g., as shown with respect to direct inclusion of the bracket assembly mounting structure 50 into the threaded hole 35 shown with in FIG. 3A).

Figure 9:
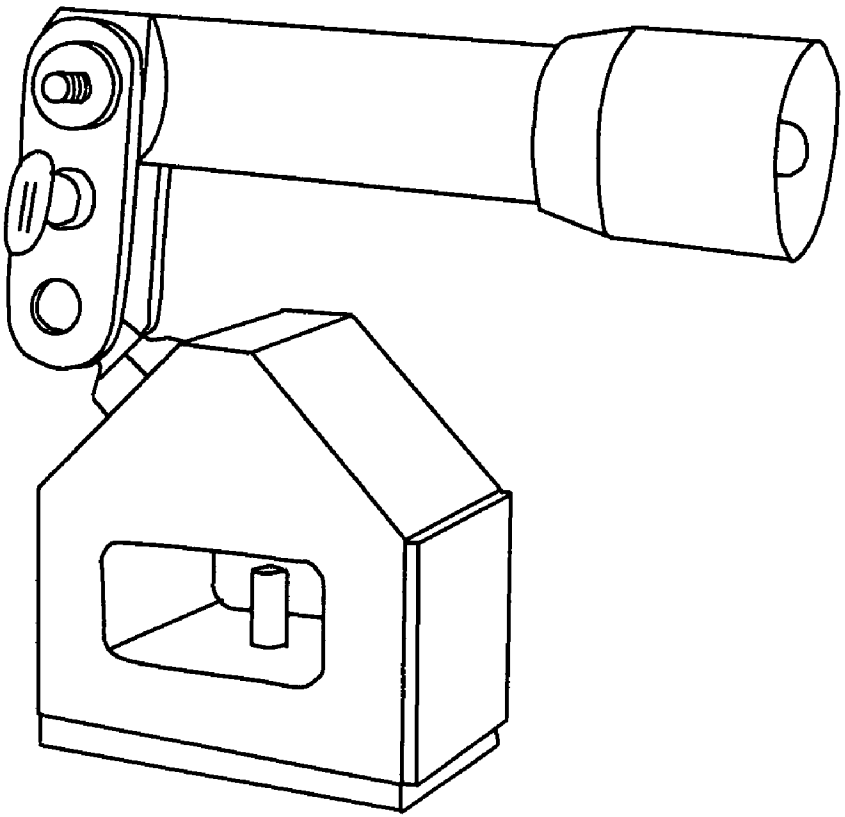
FIG. 9 shows an isometric view of another embodiment of the light mounting apparatus.

FIG. 9 shows another embodiment similar to FIGS. 1A, 1B, FIGS. 2A through 2E and FIGS. 3A through 3C, where the body has a top portion (as oriented in FIG. 9) that is substantially symmetrical.

FIGS. 10A through 10F show a light mounting apparatus 110 for holding a light source 12 relative to a tool 14, wherein the body 130 includes an extension leg 134 having the bracket assembly mounting structure 50 positioned at an end of the extension leg substantially opposite the remainder of the body 130. In addition, the light mounting apparatus shown with respect to FIGS. 10A through 10F includes a pair of receiving structures 144*a* (opposite the short mounting face) and 144*b* (opposite the long mounting face) for receiving a strap aperture 45 (shown in FIGS. 6A and 6B) of strap 42. In addition, both the long face (along the length of the extension leg) and the short face are shown having grooved regions 133*a* and 133*b*, as well as cushion members 178*a* and 178*b*. Accordingly, light mounting apparatus 110 may be positioned with the face having cushion member 178*a* positioned upon the tool 14 (e.g., as shown with respect to FIGS. 10G, 10H and 10I, whereby strap aperture 45 of strap 42 is positioned over receiving structure 144*a*, or alternatively, light mounting apparatus 110 may be positioned with the face having cushion member 178*b* positioned upon the tool 14 (e.g., as shown with respect to FIG. 10J, whereby strap aperture 45 of strap 42 is positioned over receiving structure 144*b*.

Figure 10B:
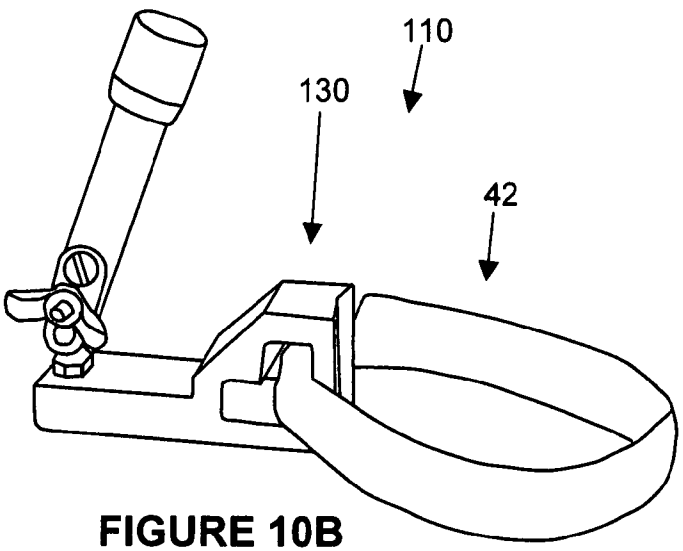
Figure 10A:
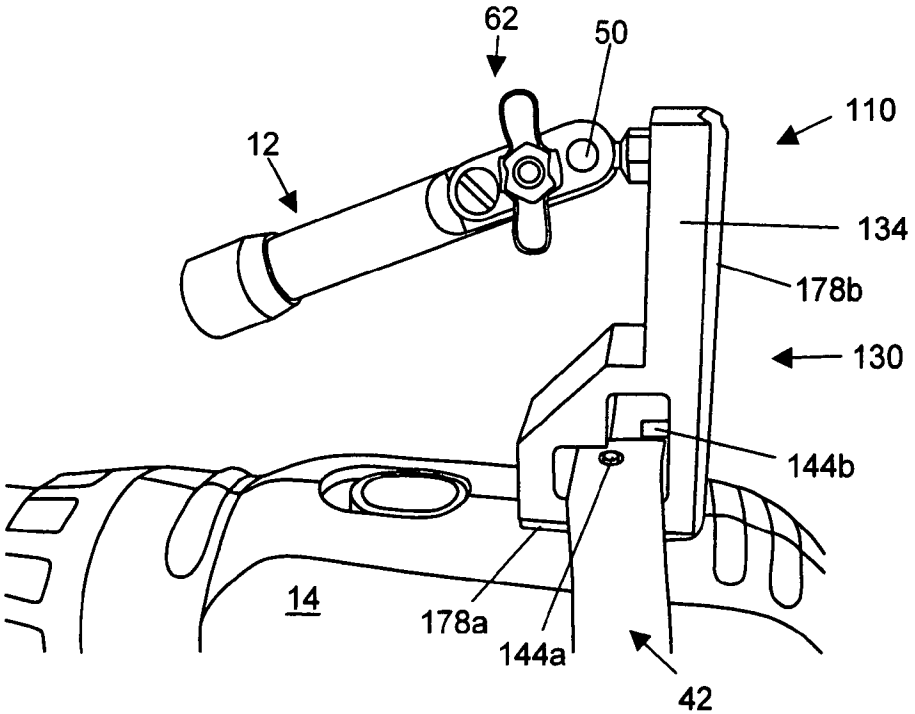
Figure 10H:
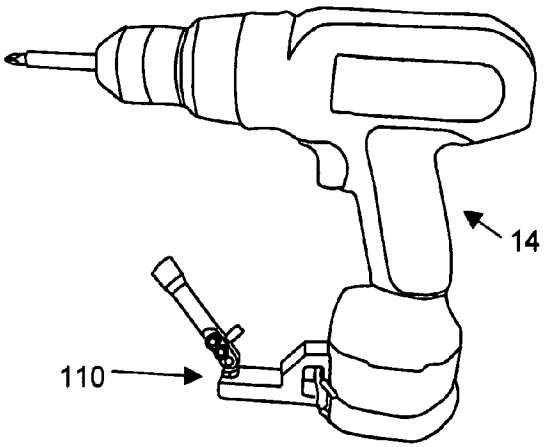
FIGS. 10G-10J show the light mounting apparatus of FIGS. 10A-10F attached to the back end of a tool having the extended leg protruding upwards therefrom, the bottom portion of a tool having the extended leg protruding therefrom, the front portion of a tool having the extended leg protruding sideways therefrom, and the bottom portion of a tool having the extended leg along the tool.
Figure 10J:
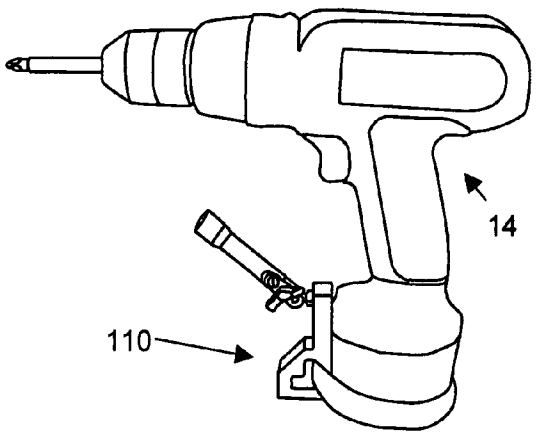
Figure 10G:
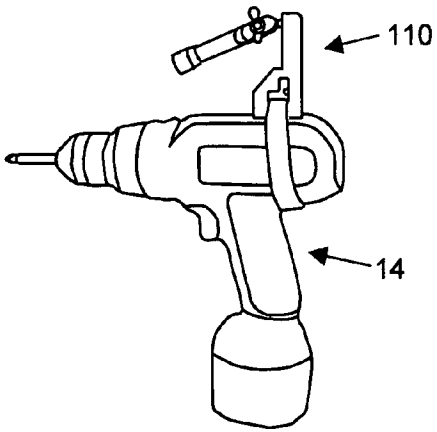
Figure 10I:
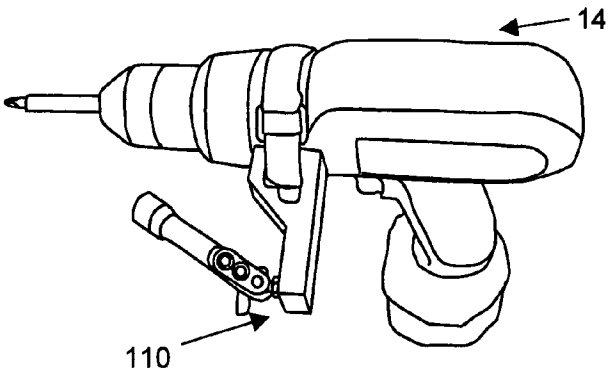

FIGS. 10G through 10J show the light mounting apparatus 110 of FIGS. 10A-10F removably attached to the tool 14. FIG. 10G shows the light mounting apparatus 110 removably attached to the back end of tool 14 having the extended leg protruding upwards therefrom. FIG. 10H shows the light mounting apparatus 110 removably attached to the bottom portion of a tool having the extended leg protruding therefrom. FIG. 10I shows the light mounting apparatus 110 removably attached to the front portion of a tool having the extended leg protruding sideways therefrom. FIG. 10J shows the light mounting apparatus 110 removably attached to the bottom portion of a tool having the extended leg along the tool.

Figure 11A:
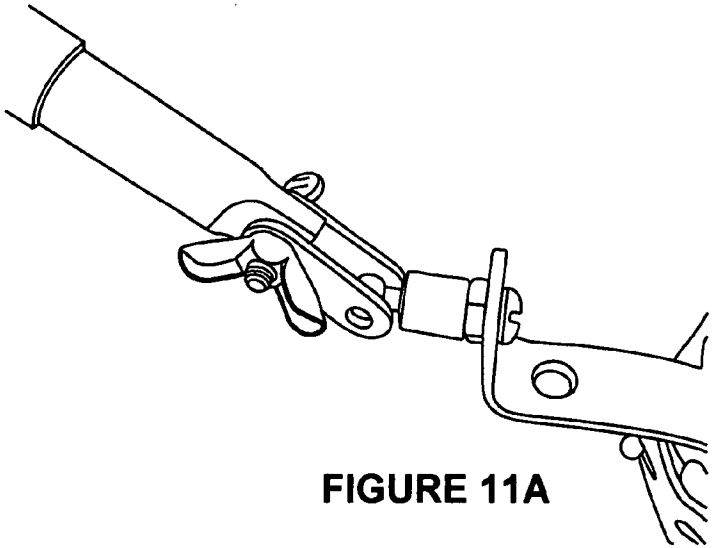
FIGS. 11A and 11B show an additional embodiment of a light mounting apparatus herein.
Figure 11B:
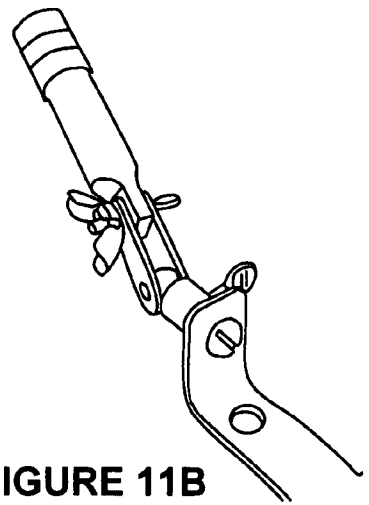
Figure 11C:
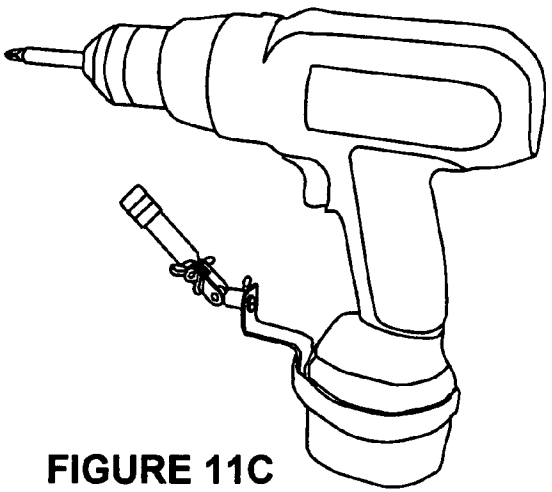
FIG. 11C shows the light mounting apparatus of FIGS. 11A and 11B attached to the base of a tool.

FIGS. 11A through 11C show another embodiment of the light mounting apparatus herein, wherein a body is in the form of a contiguous flat member having a bracket assembly mounting structure in the form of a ball having a bracket assembly attached thereon, similar to that described herein with respect to FIGS. 3A through 3D. A seating base is also provided, having a curved shape to fit the contour of commonly used tolls, e.g., drills, for example, similar to that shown with respect to FIGS. 12A and 12B, infra.

Figure 12A:
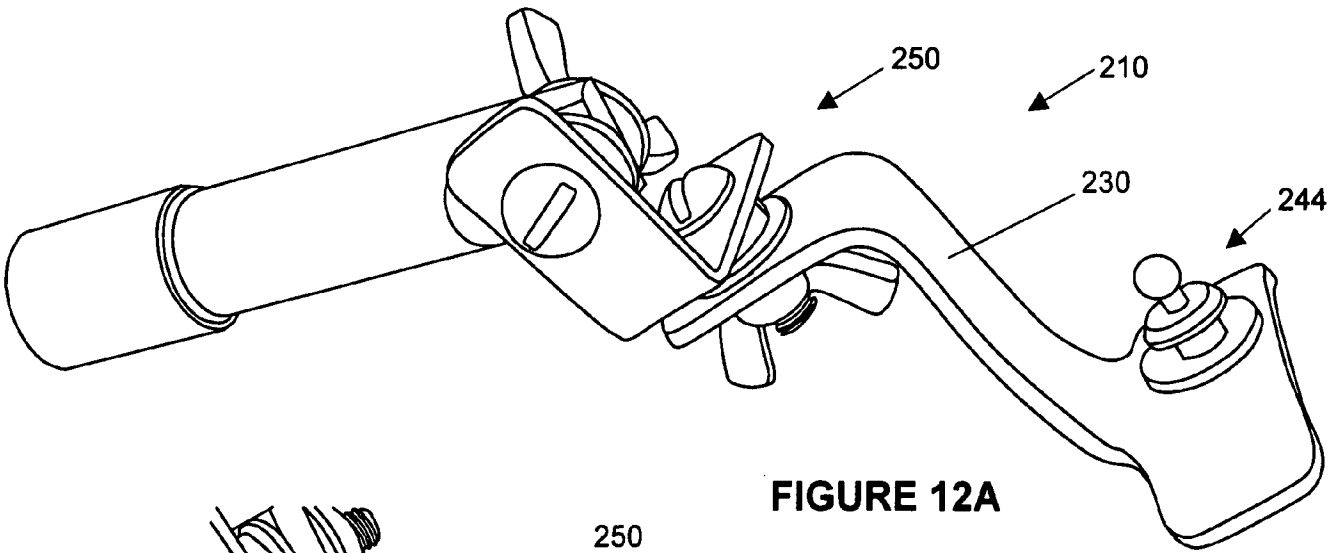
FIGS. 12A-12C show another embodiment of a light mounting apparatus herein.
Figure 12B:
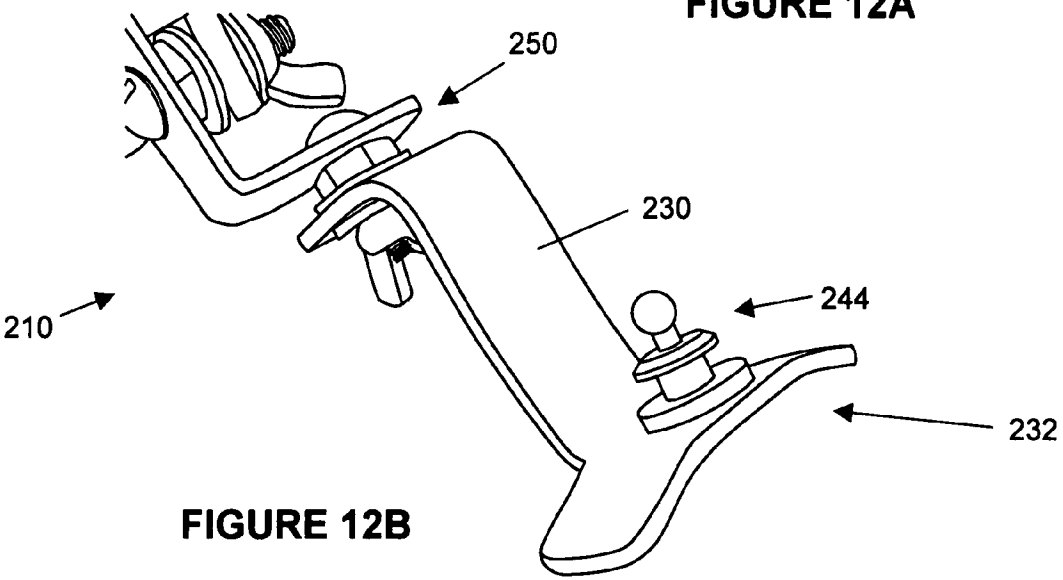
Figure 12D:
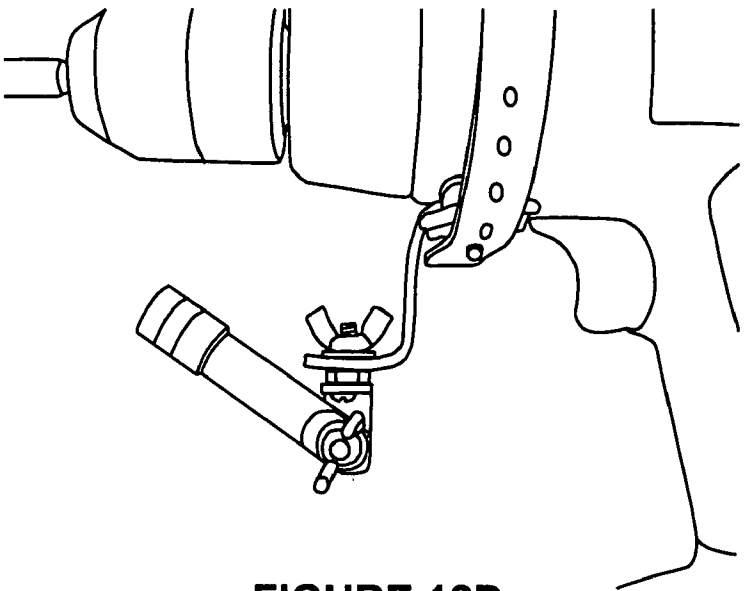
FIG. 12D shows the light mounting apparatus of FIGS. 12A-12C attached to the front portion of a tool.
Figure 12C:
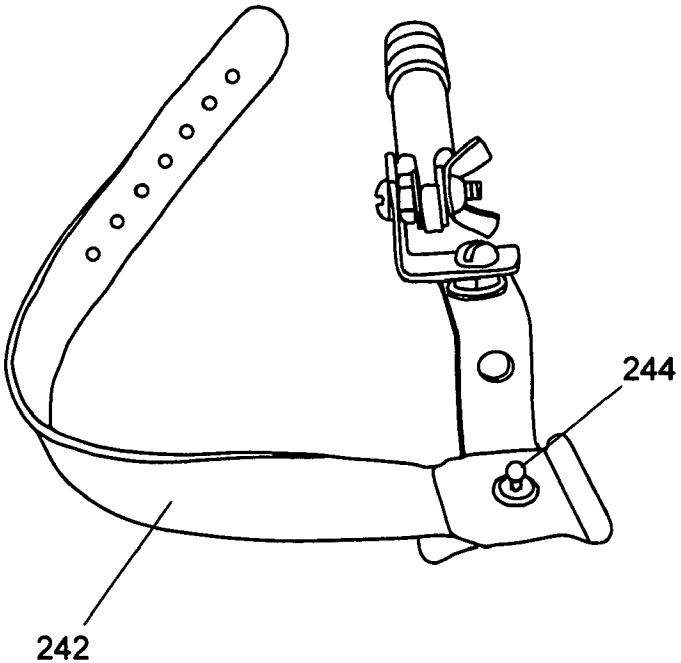

FIGS. 12A through 12D show another embodiment of the light mounting apparatus 210 herein, wherein a body 230 is in the form of a contiguous flat member having a light mounting structure 250 in the form of a twisting interface (e.g., wherein one leg of an L bracket holds the light source and another leg of an L bracket attaches to the body 230. A seating base 232 is also provided, having a curved shape to fit the contour of commonly used tools, e.g., drills. A receiving structure 244 is positioned on the side of the seating base 232 opposite the surface to position adjacent the tool, where a strap aperture is positioned over this receiving structure and cinched tightly upon the tool. FIG. 12C shows the light mounting apparatus 210 including a strap 242, for instance, in the form of an elastic material such as natural or synthetic rubber. One end is secured over the receiving structure 244, and the opposing end wrapped around the tool and cinched tightly, and one of a plurality of apertures along the length of the strap 242 is also positioned over the receiving structure 244, thereby holding the light mounting apparatus 210 in place. FIG. 12D shows the light mounting apparatus 210 positioned towards the front of a tool.

Figure 13A:
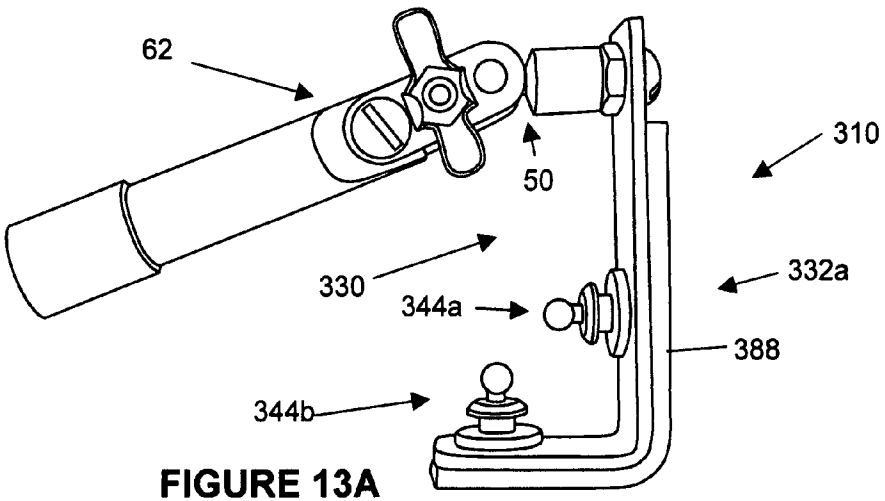
FIGS. 13A-13C show a further embodiment of a light mounting apparatus herein.
Figure 13B:
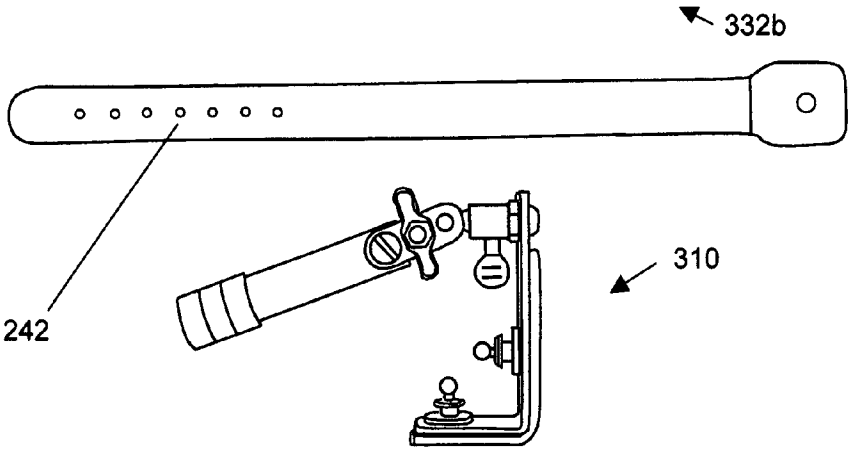
Figure 13C:
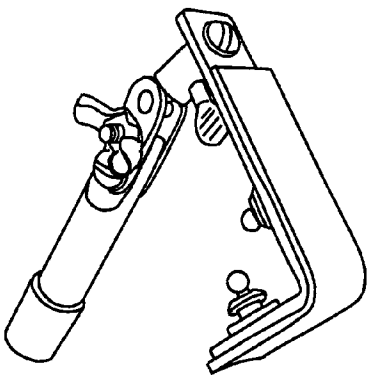
Figure 13E:
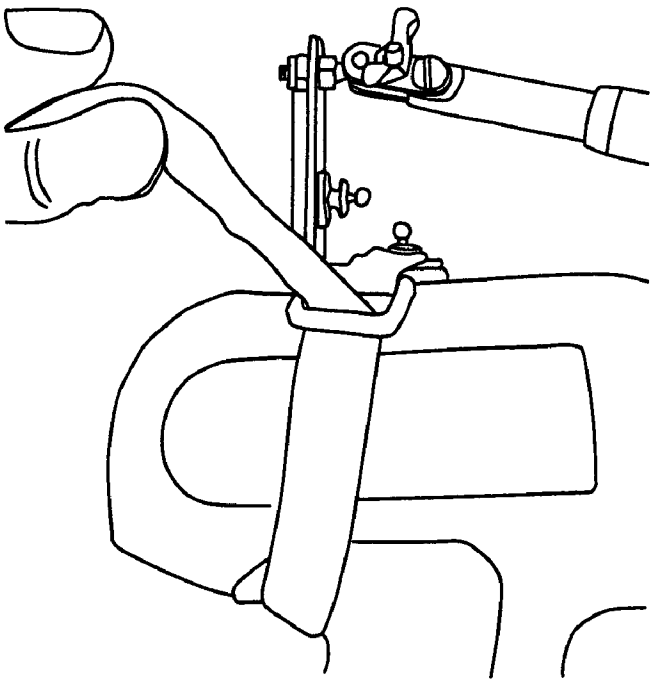
FIGS. 13D-13F show steps in attaching the light mounting apparatus of FIGS. 13A-13C to a tool.
Figure 13D:
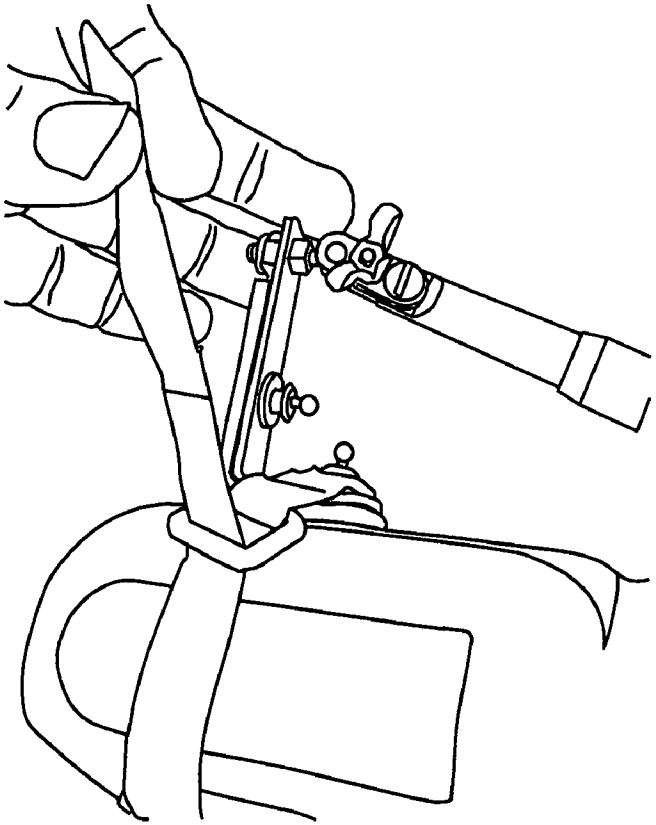
Figure 13G:
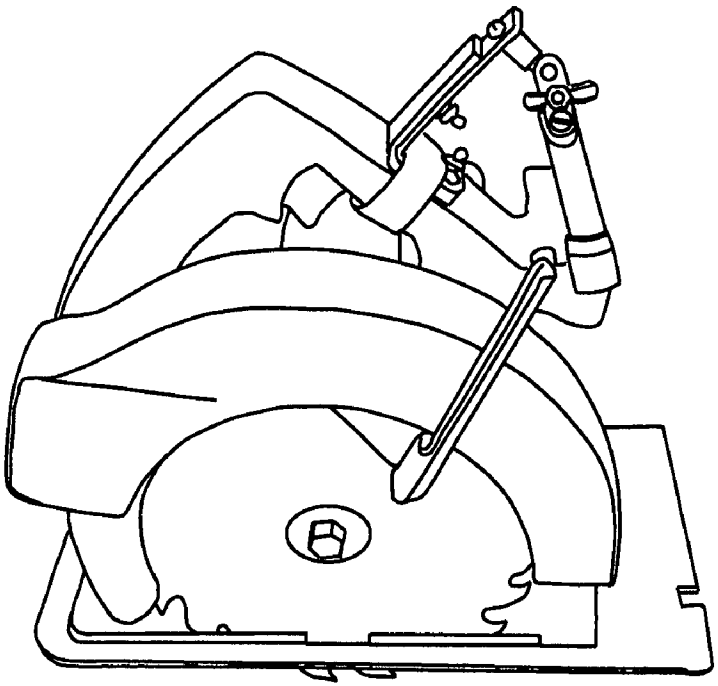
Figure 13F:
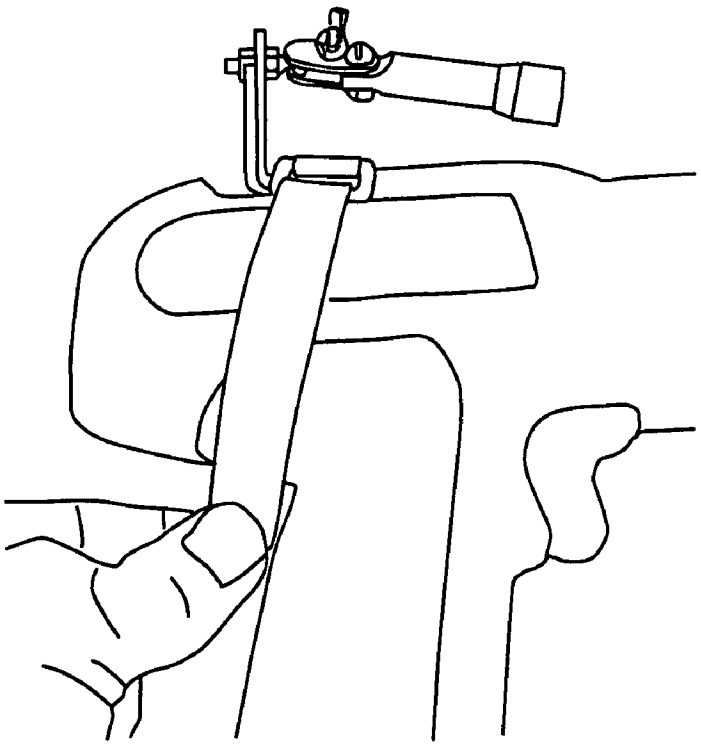

FIGS. 13A through 13C show another embodiment of a light mounting apparatus 310, wherein a body 330 is in the form of an L shape, having strap receiving structures 344*a* and 344*b* upon each leg of the body 330, thereby providing alternate seating bases 332*a* and 332*b* having a cushion portion 388 that wraps around the mounting face side of the body 330 to cover at least a portion of the seating bases 332*a* and 332*b*. As shown, the bracket assembly 62 is adjustably attached to a ball portion of the bracket assembly mounting structure 50. FIG. 13B shows a kit including the light mounting apparatus 310 having a strap 242 in the form of an elastic strap with apertures along the length at one end thereof, and an aperture at another end thereof, e.g., similar to that shown and described with respect to FIG. 12C. Of course, as described above, the strap may also include a non-elastic strap, for instance, as shown and described with respect to FIGS. 6A and 6B. For instance, FIGS. 13D, 13E and 13F show steps of inserting one end through a cinch ring of a strap (after an aperture thereon is positioned over a receiving structure), pulling it through the cinch ring, and attaching the hook portion of a hook and loop fastener system (the portion pulled by the fingers in the figures) for temporarily securing the apparatus to the tool. FIG. 13G shows the light mounting apparatus temporarily secured to a saw, whereby light may be shone upon a desired cut line.

Figure 15O:
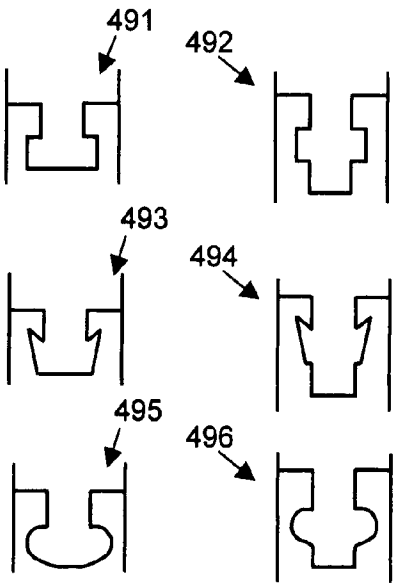
FIG. 15O shows different sliding interlock connections for the seating portions of FIGS. 15A-15N.
Figure 15B:
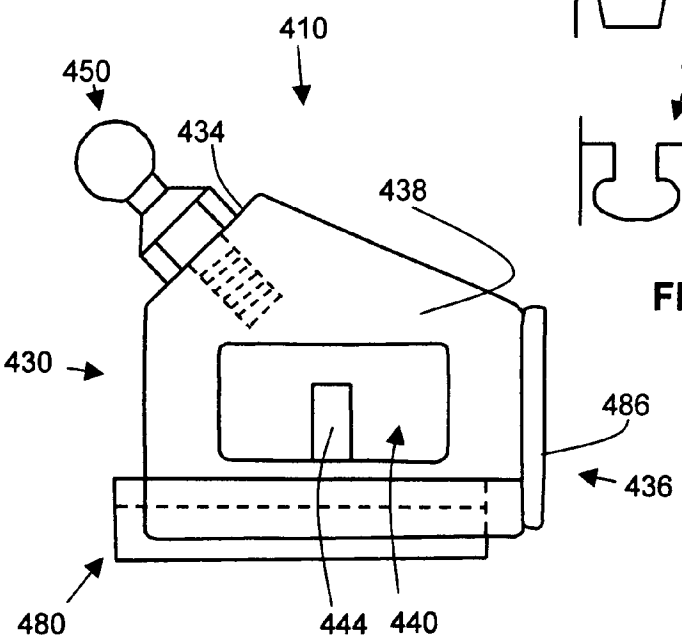
FIGS. 15A and 15B show elevation and side views of an embodiment of the light mounting apparatus with a separable seating portions.
Figure 15A:
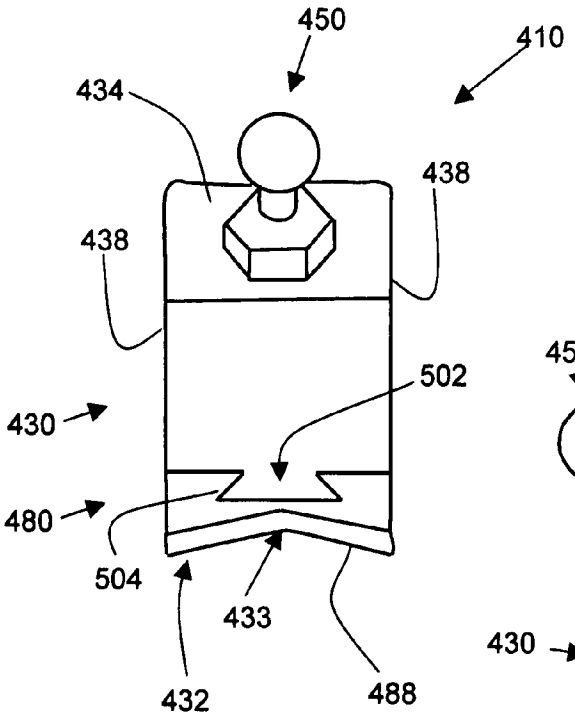

Referring now to FIGS. 15A and 15B, side and end elevation views of a body 430 and a tool seating portion 480 of a light mounting apparatus 410 provided, with FIG. 15B showing the tool seating portion 480 having a cushion member 488 (similar to cushion member 88 shown in FIGS. 1A, 1B and FIGS. 3A through 3C) partially slid away from the body 430. In general, the assembly of the body 430 and the tool seating portion 480 may be similar to body 30, for instance, described with respect to FIGS. 3A through 3C, including side faces 438 and a plurality of faces 432, 434, 436. The face 432, in the embodiment of apparatus 410, is part of a seating portion 480, and provides a seating base 432, configured for seating the apparatus 410 upon various locations upon a tool. In addition, the face 434 provides a light mount face 434 (e.g., a bracket assembly mounting structure 50 is in the form of a ball attached to a threaded portion). The body 430 also includes another face 436 (adjacent the seating base 432), along with other optional faces. The body 430 further includes a strap receiving aperture 440, which is configured and dimensioned to allow a strap 42 (shown in FIGS. 2A through 2E and FIGS. 6A and 6B) to pass therethrough. A receiving structure 444 is within the strap receiving aperture 440 that is configured, positioned and dimensioned for receiving an aperture 45 of a strap 42 (FIGS. 6A and 6B). Furthermore, a magnetic portion 486 may optionally be incorporated upon the body 430. For instance, as shown in the figures, a magnetic portion 486 on face 436.

Light mounting apparatus 410 includes the body 430 may be slidably connected upon the seating portion 480. FIGS. 15A and 15B show a seating portion 480 that, when assembled with the body 430, is suitable for attaching to a tool as described herein. For instance, the body 430 may include a male sliding interlock 502 (shown in the example of FIGS. 15A and 15B in the form of a male dovetail portion), which slidably engages a female sliding interlock 504 formed in the extension mount 480. Alternatively, the male sliding interlock and female sliding interlock may have matching cross sectional shapes other than dovetail, for instance, including but not limited to circular, oval, or various types of "bobtail" interlocks, for instance, as shown in FIG. 15O (where a straight bobtail interlock 491 (a rectangular portion having a neck, a straight bobtail through interlock 492 (a rectangular portion having a neck and an extended section), an angled bobtail interlock 493 (an angular cross section portion having a neck), an angled bobtail through interlock 494 (an angular cross section portion having a neck and an extended section), a circular bobtail interlock 495 (a circular cross section portion having a neck), and a circular bobtail through interlock 496 (a circular cross section portion having a neck and extended portion) are shown).

Light mounting apparatus 410 allows the device to have greater versatility by enabling different seating portions to be removably attached, or permanently affixed, to a variety of surfaces, and allowing the body 430 to be attached by simply sliding it on. For example, seating portions may include the tool seating portion 480, or other seating portions including but not limited to a flat surface (e.g., for attaching with the straps described herein to a flat surface, or to be adhesively mounted to a surface), suction cups, hook and loop type materials (e.g., Velcro®), double sided tape, magnets, screws, or other permanent attachment systems or removable attachment systems. In addition, a tool seating portion 480 may be provided with different angles of the grooved regions 433, for instance, for use with different tools, or alternatively a tool seating portion 480 may be provided with a curved radius base, allowing adaptation to tools of differing sizes or on different locations of tools. Additionally, the base may be provided with sizes that are larger or smaller. Therefore, a kit may be provided to a user with a plurality of different seating portions (or even plural bases that are the same, for instance, to allow for permanent mounting at different locations for convenience of a user).

Figure 15F:
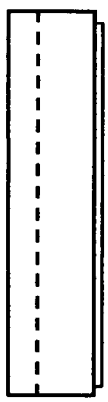
FIGS. 15C-15N show various elevation and side views of different seating portions for use with the embodiment of the light mounting apparatus shown in FIGS. 15A and 15B.
Figure 15E:
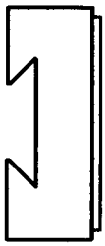
Figure 15D:
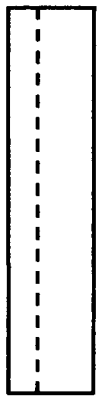
Figure 15C:
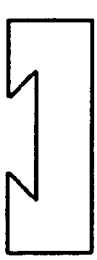
Figure 15J:
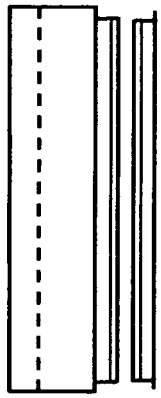
Figure 15I:
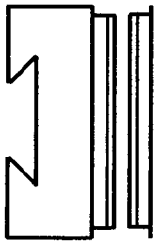
Figure 15H:
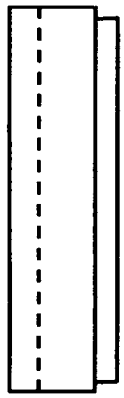
Figure 15G:
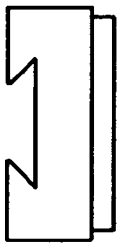
Figure 15L:
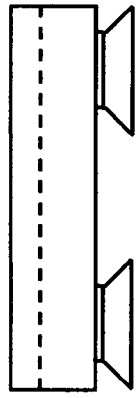
Figure 15K:
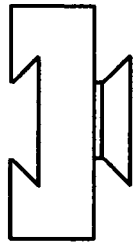
Figure 15N:
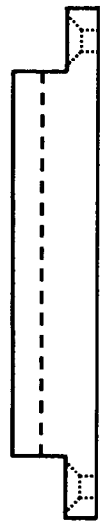
Figure 15M:
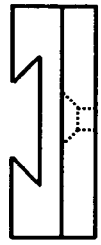

For example, FIGS. 15C and 15D show elevation and side views of a flat bottom seating portion. FIGS. 15E and 15F show elevation and side views of a flat bottom seating portion with, for instance, double sided tape adhered thereto. FIGS. 15G and 15H show elevation and side views of a seating portion with a magnet attached to the bottom thereof. FIGS. 15I and 15J show elevation and side views of a flat bottom seating portion having hook (or loop) fasteners adhered to the bottom thereto, where the corresponding loop (or hook) fastener is also shown, and may be attached to many different surfaces with suitable adhesive, as is commonly known with hook and loop fastener systems such as Velcro®. FIGS. 15K and 15L shown elevation and side views of a seating portion having suction cups at the bottom thereof. FIGS. 15M and 15N show elevation and side views of a seating portion having suitable screw holes for mounting the seating portion upon a desired surface with screws. Other variations are also possible and envisions as being within the scope of the invention.

Figure 16:
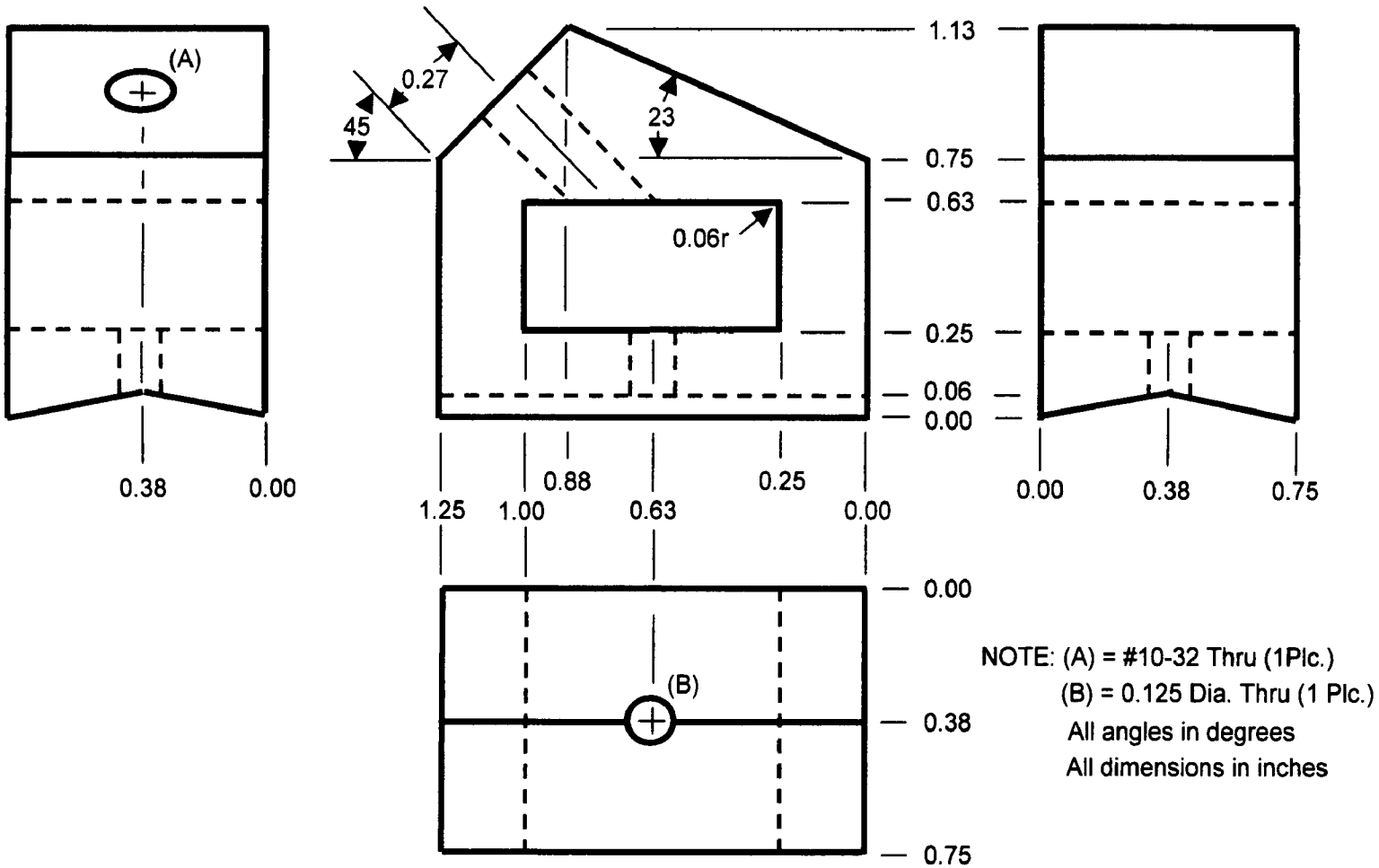
FIG. 16 shows a preferred embodiment of the light mounting apparatus.

FIG. 16 shows dimensional specifications of an embodiment herein similar to that described with respect to FIGS. 1, 2A through 2E and 3A through 3C. These dimensions represent an apparatus 10 particularly well suited for power tools including but not limited to various drills, saws, and other tools as described further herein.

The light mounting apparatus provided herein may be used with a variety of tools, including but not limited to drills and drivers (e.g., cordless, corded, pneumatic, corded and cordless rotary hammer drills, corded and cordless power screwdrivers, corded, cordless and pneumatic impact drivers, drill presses), saws (e.g., corded and cordless circular saws, corded and cordless jig saws, corded and cordless reciprocating saws), and other corded, cordless and pneumatic tools including but not limited to grinders, die grinders, belt sanders, oribital sanders, polishers, shears, nibblers, nailers, staplers, cut off tools, plate joiners, routers, caulking guns/adhesive dispensers, cut-out tools, ratchets (e.g., pneumatic), and high revolution per minute rotary tools. Further, one or more of the light mounting apparatus may be removably attached to a weapon, such as a hunting weapon or for use by law enforcement.

In addition, one or more light mounting apparatus may be used with other flashlights, for example, to illuminate separate areas, increase the light swath, modify the shape of the light beams(s), or provide other desired functionality.

Furthermore, one may use one or more of the light mounting apparatus in any desired locale, such as in one's workshop, home or office, within an automobile, on a bicycle, or other location.

In addition, while the embodiments shown are based on holding and positioning small flashlights (e.g., less than about three inches in length), the light mounting apparatus may be used in various scales, smaller or larger, for application to a wide range of dimensioned light sources. Desirably, the light source or flashlight includes an end having an aperture 16 for being held by the light holding structure 64 through the apertures 74 of the brackets 70 (e.g., for attachment to a bracket assembly 62 as shown in FIGS. 7A and 7B).

In certain alternative embodiments, one or more batteries may be incorporated into the body, whereby the light source includes suitable connection to derive power from the body. For instance, one or more wires may pass through between brackets of bracket assembly, alongside the brackets, or through the brackets (e.g., one or more brackets formed with a wire mounted therethrough. In a further alternative, the plug may also provide structural interconnection (in conjunction with the light holding structure 54, or alternatively as the sole structural interconnection. For example, screws may be included along side the electrical interconnection (e.g., similar to a serial cable) to align and fasten to threaded holes on a portion of the light source, or clips may be included along side the electrical interconnection (e.g., similar to a parallel cable) to align and fasten to protrusions or notices on a portion of the light source.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A light mounting apparatus for securing a light source, the light source including a light source aperture integrated with the light source or structurally connected to the light source, the light mounting apparatus comprising:

a body having a seating portion and a strap receiving portion;

a bracket assembly including a pair of opposable brackets, each bracket having a first aperture, a second aperture and a third aperture, a light holding structure positioned through the first apertures of the brackets adapted to secure a light source through a light source aperture between the brackets, and an adjustment structure through the second apertures of the brackets including at least a first position whereby the brackets are drawn towards one another, and a second position whereby the brackets are further separated from one another, and a bracket assembly mounting structure attached to the body including a ball portion, wherein the third apertures of the brackets are positioned proximate the ball portion of the bracket assembly mounting structure, wherein, in the second position, the orientation of the brackets are movable relative to the ball portion and the orientation of the light source is movable relative to the brackets, and in the first position the orientation of the brackets are fixed relative to the ball portion and the orientation of the light source is fixed relative to the brackets.

2. The light mounting apparatus as in claim 1, wherein the bracket assembly mounting structure is attached to a body at a face of the body separate from the seating portion.

3. The light mounting apparatus as in claim 1, wherein the body includes the seating portion on a face of the body.

4. The light mounting apparatus as in claim 1, wherein the seating portion of the body includes a concave portion.

5. The light mounting apparatus as in claim 1, wherein the seating portion of the body includes a V-shaped portion.

6. The light mounting apparatus as in claim 1, wherein the seating portion of the body includes a cushion member.

7. The light mounting apparatus as in claim 3, wherein the seating portion is slidably connected to the body with a sliding interlock connection.

8. The light mounting apparatus as in claim 7, further comprising one or more additional seating portions.

9. The light mounting apparatus as in claim 1, wherein the body includes a magnetic portion on a face of the body separate from a face of the body having the seating portion.

10. The light mounting apparatus as in claim 1, wherein the strap receiving portion of the body includes a receiving structure configured, positioned and dimensioned for receiving an aperture of a strap.

11. A kit comprising the light mounting apparatus as in claim 1;

the light source including a light source aperture integrated with the light source or structurally connected to the light source; and a strap configured and dimensioned for passing through the strap receiving portion of the body and wrapping around a tool, an object or a structure.

12. The kit as in claim 11, further comprising one or more additional straps of different length.

* * * * *